US005215012A

United States Patent [19]

Kanno et al.

[11] Patent Number: 5,215,012

[45] Date of Patent: Jun. 1, 1993

[54] RIBBON CARTRIDGE FOR PRINTERS

[75] Inventors: Tetsuo Kanno, Fujisawa, Japan; Kenneth D. Seevers, Lexington, Ky.; Mamoru Watanabe, Yokohama, Japan

[73] Assignee: Lexmark International, Inc., Greenwich, Conn.

[21] Appl. No.: 814,755

[22] Filed: Dec. 30, 1991

[51] Int. Cl.[5] ..... B41J 31/14

[52] U.S. Cl. ..... 400/200; 400/196.1; 400/235.1

[58] Field of Search ..... 400/194, 195, 197, 198, 400/200, 202, 196, 201, 196.1, 235.1

[56] References Cited

U.S. PATENT DOCUMENTS

| | | | |
|---|---|---|---|
| 4,048,952 | 9/1977 | Peterson et al. | 118/673 |
| 4,071,133 | 1/1978 | Scherrer et al. | 400/196 |
| 4,091,914 | 5/1978 | Stipanuk | 400/196.1 |
| 4,247,209 | 1/1981 | Carlson et al. | 400/195 |
| 4,449,838 | 5/1984 | Okamura et al. | 400/234 |
| 4,616,942 | 10/1986 | Nagasawa et al. | 400/196.1 |
| 4,636,097 | 1/1987 | Goubeaux | 400/196.1 |
| 4,653,947 | 3/1987 | Echols | 400/202.4 |
| 4,741,639 | 5/1988 | Fausto et al. | 400/196.1 |
| 4,747,713 | 5/1988 | Kikuchi et al. | 400/202.4 |
| 4,913,571 | 4/1990 | Bulson et al. | 400/196.1 |

FOREIGN PATENT DOCUMENTS

| | | |
|---|---|---|
| 59-131851 | 9/1984 | Japan . |
| 62-248677 | 10/1987 | Japan . |
| 4-7155 | 1/1992 | Japan . |

*Primary Examiner*—Edgar S. Burr
*Assistant Examiner*—Christopher A. Bennett
*Attorney, Agent, or Firm*—Bell, Seltzer, Park & Gibson

[57] ABSTRACT

A replaceable ribbon cartridge for printers is disclosed and which has a user controllable re-inking capability. The cartridge includes both an ink transfer roller and a drive roller, both of which contact the advancing ribbon during printing operations. Also, a re-inking roller is provided, and the re-inking roller is laterally moveable so as to permit the user to selectively move the re-inking roller to a neutral position wherein it has no substantial contact with either the ink transfer roller or the drive roller, to a first operative position wherein the re-inking roller is in substantial contact only with the ink transfer roller, or to a second operative position wherein the re-inking roller is in contact with both the ink transfer roller and the drive roller.

13 Claims, 4 Drawing Sheets

RIBBON CARTRIDGE FOR PRINTERS

TECHNICAL FIELD

The present invention relates to a replaceable ribbon cartridge for printers and having a user controllable re-inking capability.

BACKGROUND OF THE INVENTION

Replaceable ribbon cartridges adapted for use with computer printers, typewriters, and other types of printers are well-known in the art. Typically, such cartridges include a casing which houses an endless inked ribbon, together with a drive arrangement which is operated by the printer to move the ribbon along an endless path of travel and past a printing location which is outside of the casing and where the ribbon is engaged by the printing mechanism. The drive arrangement commonly comprises a rotatable drive roller, together with an idler or pinch roller which is spring biased against the drive roller to engage the ribbon which passes therebetween.

After a period of use of the cartridge, the ribbon's supply of ink becomes depleted, and the quality of the print deteriorates. To extend the life of the cartridge, it has been proposed to provide the cartridge with a re-inking capability. More particularly, in one prior design of this type, a porous ink filled roller is mounted in the casing so as to directly engage the ribbon drive roller, and during use, the drive roller transfers the ink to the ribbon. A design of this type is illustrated for example in U.S. Pat. No. 4,653,947. In another prior design, and as illustrated for example in U.S. Pat. Nos. 4,913,571 and 4,741,639, and Japanese Utility Model Publication No. 4-7155, a porous, ink filled roller is rotatably mounted in the casing, with the ink filled roller being in contact with a transfer roll which in turn engages the ribbon. The noted Japanese Utility Model also teaches that the ink filled roller may be moved laterally by the user to vary the contact pressure between the ink filled roller and the transfer roller, to thereby vary the rate of ink transfer.

The above prior designs are not, however, seen to be able to provide the user with a re-inking capability which may be significantly varied to meet applications having widely varying printing requirements. For example, the prior designs are not seen to be capable of permitting selective operation at a light transfer rate during the early life of the ribbon, and then shifting to a much heavier transfer rate when the print quality begins to deteriorate or when heavy ink transfer is required, such as in high speed printing operations or in the printing of graphics.

It is accordingly an advantage of the present invention that it provides a replaceable ribbon cartridge for printers and which has a user controllable re-inking capability which may be varied between a relatively light ink transfer rate, and a much heavier ink transfer rate.

It is a more particular advantage of the present invention that it provides a replaceable ribbon cartridge which incorporates a movable re-inking roller which is movable by the user between a neutral or inoperative position, a first operative position wherein the re-inking roller contacts a first ink transfer roller adapted for light ink transfer to the ribbon, and a second operative position wherein the re-inking roller contacts a second ink transfer roller adapted for heavy ink transfer to the ribbon.

SUMMARY OF THE INVENTION

The above and other objects and advantages of the present invention are achieved in the embodiment illustrated herein by the provision of a replaceable ribbon cartridge which comprises a casing, an endless ribbon positioned within the casing so as to be disposed along a path which includes a portion outside of the casing at a printing location, and drive means for advancing the ribbon along the path and comprising a drive roller rotatably mounted in the casing adjacent the ribbon path and so as to be in contact with the ribbon. An ink transfer roller is rotatably mounted in the casing adjacent the ribbon path and so as to be in contact with the ribbon. Also, a porous re-inking roller is rotatably mounted in the casing, and an actuator is provided which is controllable by the user for moving the re-inking roller between a first operative position in substantial contact only with the ink transfer roller and a second operative position in substantial contact with both the ink transfer roller and the drive roller.

In the preferred embodiment, the means for moving the re-inking roller has provision for moving the same to a neutral position wherein the re-inking roller has no substantial contact with either the ink transfer roller or the drive roller.

BRIEF DESCRIPTION OF THE DRAWINGS

Some of the objects and advantages of the present invention having been stated, others will appear when taken in conjunction with the accompanying drawings, in which.

DETAILED DESCRIPTION OF THE PREFERRED EMBODIMENT

Figure 2:
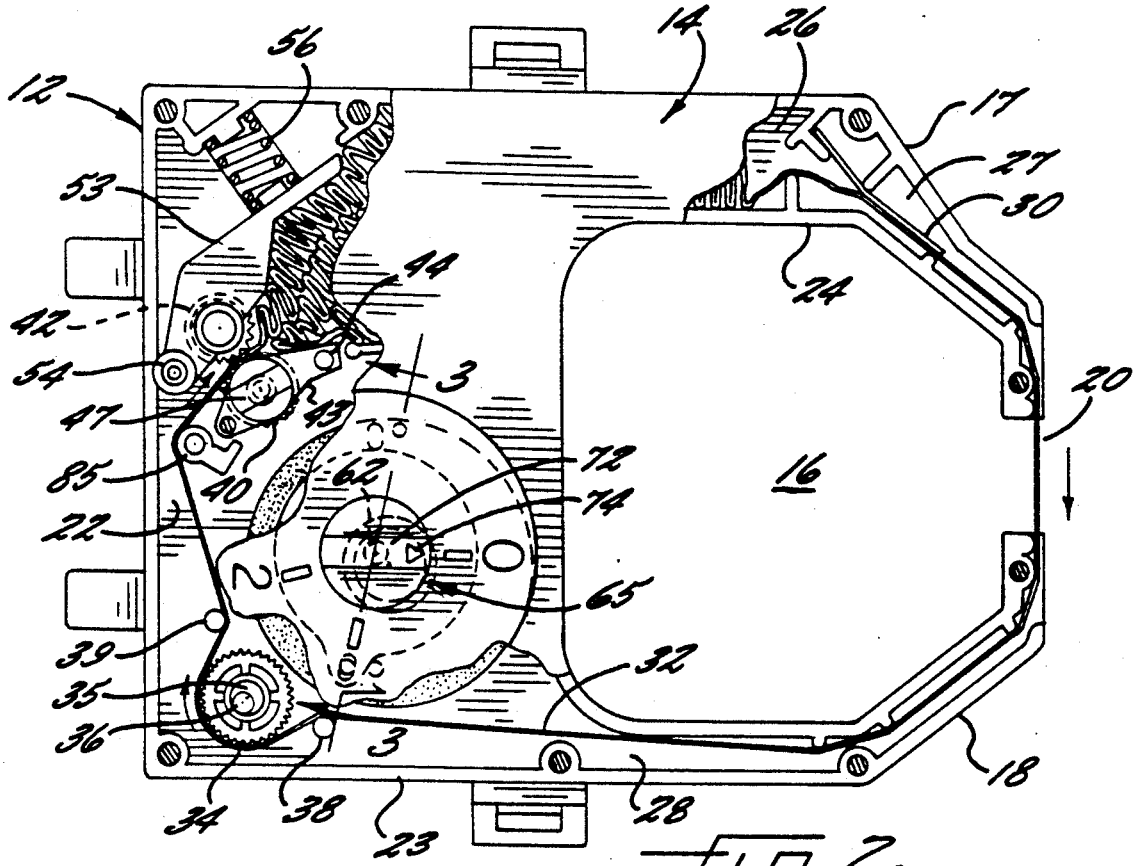
FIG. 2 is a plan view of the cartridge shown in FIG. 1, with the cover partly broken away.

Referring more particularly to the drawings, a replaceable ribbon cartridge which embodies the present invention is indicated generally at 10. The cartridge 10 comprises a casing formed of molded plastic or other suitable material, and which comprises a base member 12 and a cover 14. The casing has a somewhat C-shaped configuration as seen in FIG. 2 so as to define a central opening 16, with the opening 16 defining a supply guide arm 17 positioned above the opening as seen in FIG. 2, and a return guide arm 18 positioned below the opening. The outer extremities of the two guide arms are laterally spaced apart so as to define a printing location 20 therebetween.

The base member 12 of the casing is composed of a bottom wall 22, an outer peripheral side wall 23 which is joined to the bottom wall, and an interior side wall 24 which is joined to the bottom wall along the periphery of the opening 16 and so as to form an internal enclosure between the bottom wall 22 and the cover 14.

The internal enclosure includes a ribbon storage chamber 26, a ribbon supply passage 27 extending from the chamber 26 through the supply guide arm 17, and a ribbon return passage 28 extending through the return guide arm 18. A tension spring 30 is positioned in the ribbon supply arm 17 for the purposes further described below. An endless inked fabric ribbon 32 is positioned within the casing, with the bulk of the ribbon 32 being formed into multiple folds and positioned in the storage chamber 26.

The internal enclosure of the casing further mounts an ink transfer roller 34 which has a splined peripheral surface and a relatively large central opening 35. The ink transfer roller 34 is rotatably supported on a post 36 which extends through the central opening 35, and which is fixed to the bottom wall 22 of the base member 12. The diameter of the post 36 is significantly less than the diameter of the opening 35 so as to permit the roller 34 to move laterally a predetermined distance, as well as rotate about its axis. A ribbon guide post 38 is mounted immediately adjacent one side of the ink transfer roller 34 as seen in FIG. 2, and another ribbon guide post 39 is mounted immediately adjacent the other side of the ink transfer roller 34, for guiding the ribbon 32 about the outer peripheral surface of the roller in the manner illustrated.

To advance the ribbon 32 along its path of travel as described below, a ribbon drive means is provided, and which comprises a drive roller 40 and an idler roller 42. The drive roller 40 includes a cylindrical peripheral surface which is splined, and the drive roller is rotatably mounted to a lever arm 43, note FIG. 4. The lever arm 43 is in turn fixedly mounted between a post 44 which is fixed to the bottom wall 22, and the post 51 as further described below. The lower end of the drive roller 40 includes an axial drive bore 45 (FIG. 6), which communicates with an opening in the bottom wall 22, and which is adapted to receive the drive shaft 46 (FIG. 4) of the printer in the conventional manner. The upper end of the drive roller 40 includes a finger tab 47, which extends through an opening 48 in the cover 14, and so that the ribbon 32 may be advanced by hand by rotating the finger tab 47 in the direction of the arrow 49 which is placed on the cover. Further, the post 51 is integrally formed on the lever arm 43, and it is positioned to fit within a bore 52 in the under side of the cover 14, and so as to prevent significant lateral movement of the drive roller 40.

The idler roller 42 also includes a splined peripheral surface, and it is rotatably mounted on a lever arm 53 which in turn is pivotally mounted to a post 54 which is fixed to the bottom wall 22. The idler roller 42 is biased toward the drive roller 40 by means of a spring 56, so as to tightly engage the ribbon 32 which passes therebetween. Thus upon rotation of the drive roller 40 in the direction of the arrow 49, the idler roller 42 also rotates, and the ribbon 32 is advanced through the nip formed between the drive roller 40 and the idler roller 42.

A re-inking roller 60 formed of a porous foam material and which is initially impregnated with ink is rotatably mounted in the casing to one side of a line which extends between the ink transfer roller 34 and the drive roller 40. The re-inking roller 60 is mounted by means of a post 62 (FIGS. 3 and 4) which is fixed to the bottom wall 22 of the casing, and a central opening 63 of relatively large diameter extends through the roller 60 coaxially with its outer periphery. The post 62 is received in the opening 63, and the opening 63 has a diameter substantially larger than that of the post 62 so as to permit relative lateral movement therebetween, as well as rotation of the roller 60.

Figure 3:
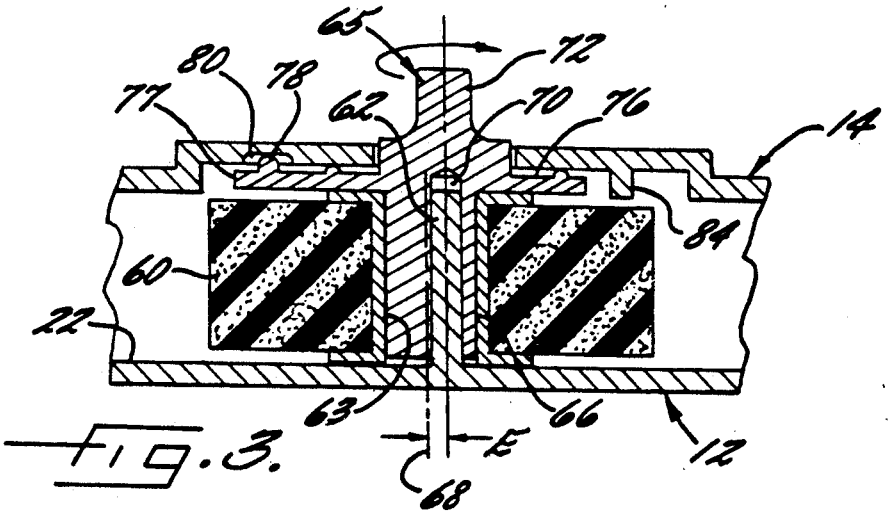
FIG. 3 is a sectional view taken substantially along the line 3—3 of FIG. 2.
Figure 4:
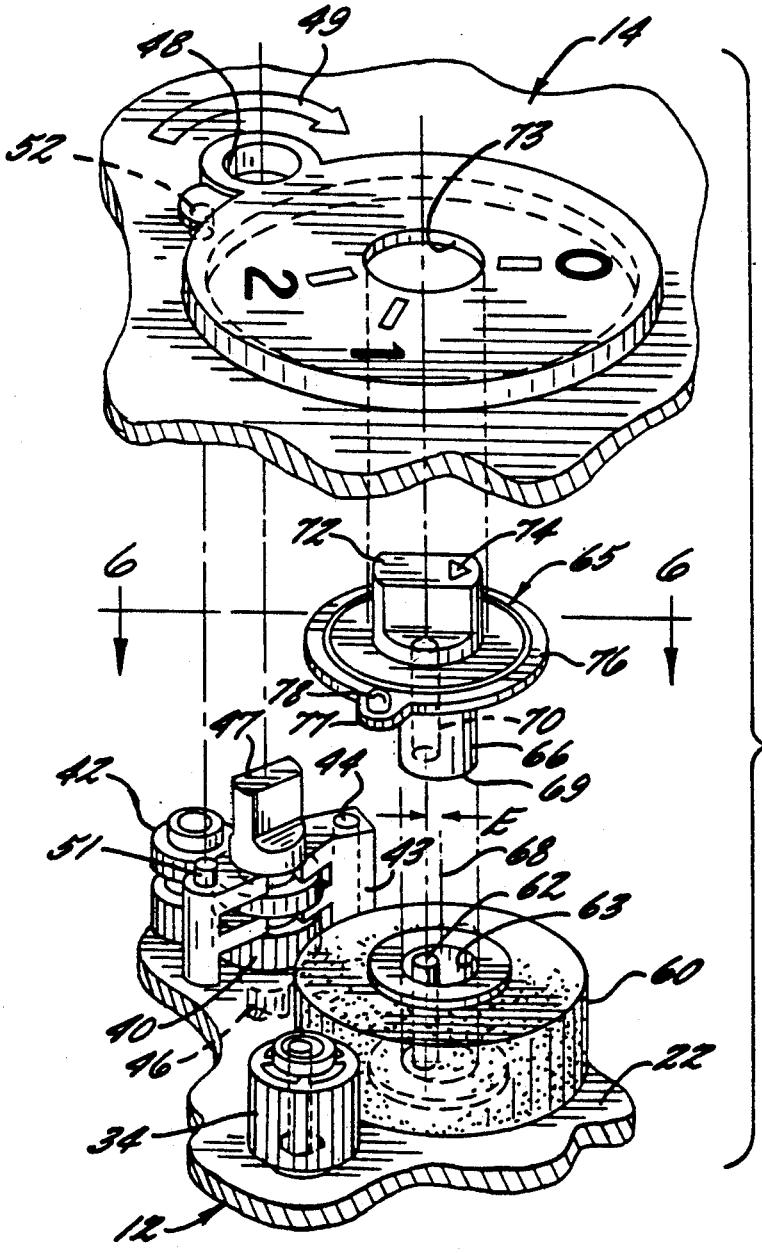
FIG. 4 is a fragmentary exploded perspective view of the re-inking components of the cartridge.

The re-inking roller 60 is adapted to be moved to a number of predetermined lateral positions by the user, by means of an actuator 65 which is best seen in FIGS. 3 and 4. The actuator 65 comprises a cylindrical shaft 66 which is sized so as to be closely received in the central opening 63 of the re-inking roller 60, while permitting the re-inking roller 60 to rotate about the cylindrical shaft 66. Also, the cylindrical shaft 66 defines a central shaft axis 68 and an outer end 69. A bore 70 extends axially into the outer end 69 of the shaft 66 and is laterally offset from the shaft axis 68 as indicated at E in FIGS. 3 and 4, and the bore 70 receives the mounting post 62 therein. By this arrangement, rotation of the actuator 65 causes the cylindrical shaft 66 and the re-inking roller 60 to eccentrically or laterally move with respect to the mounting post 62.

Figure 5:
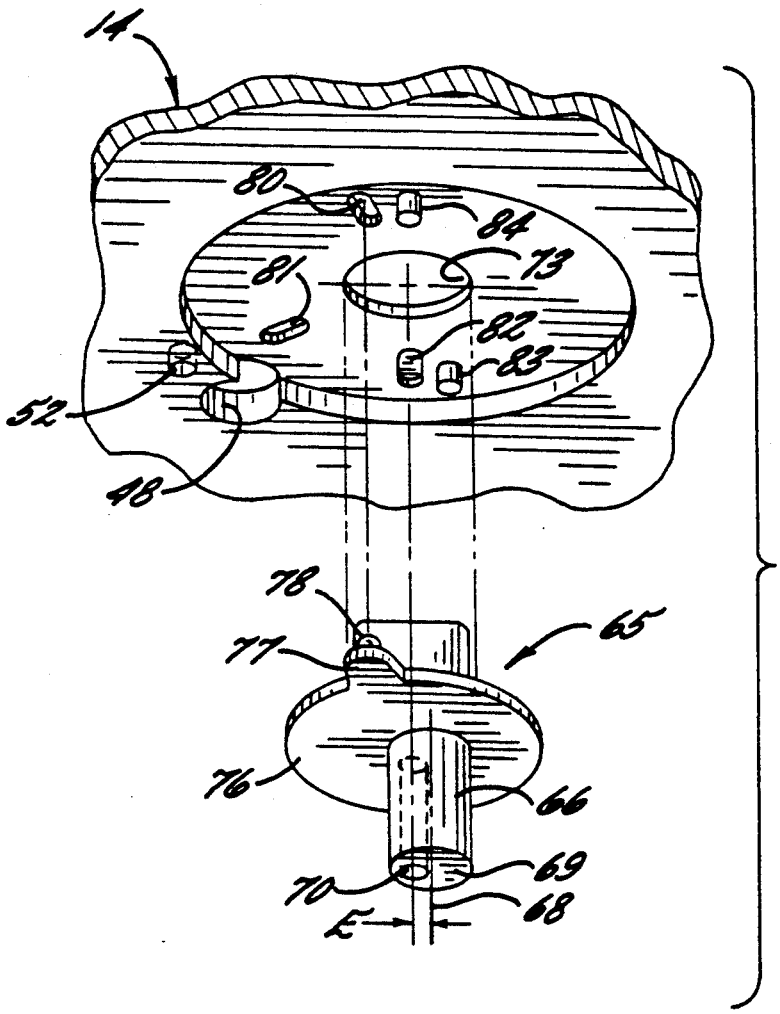
FIG. 5 is a fragmentary exploded perspective view of the actuator and the underside of the cover of the cartridge.

The actuator 65 also includes an integral tab 72 which extends through an opening 73 in the cover 14 and which is adapted to be engaged by the fingers of the user for rotating the same about the mounting post. The upper surface of the tab 72 includes a printed pointer 74 for the purposes described below. Further, the actuator 65 includes a radial flange 76, which is disposed adjacent the inside surface of the cover 14, and the flange 76 includes a radial finger 77 and an axial detent 78 positioned on the finger 77. The inside surface of the cover 14 closely overlies the flange 76 as best seen in FIG. 3, and the inside surface includes a plurality of indentations 80, 81, 82 (FIG. 5) positioned for respectively receiving the detent 78 therein at each of a plurality of predetermined rotational positions, as hereinafter further described. The inside surface also mounts a pair of posts 83, 84, which are adapted to be engaged by the radial finger 77 to thereby limit the rotational movement of the actuator 65 between predetermined limits.

The ribbon 32 is disposed along a path which leads from the storage chamber 26, through the ribbon supply passage 27 and past the tension spring 30, which is self biased into contact with the ribbon. The ribbon then extends across the printing location 20 between the outer ends of the guide arms 17, 18, and it then enters the return guide arm 18 and extends through the ribbon return passage 28. From the return passage 28, the ribbon 32 is guided along the rear side of the ink transfer roller 34 by the guide posts 38, 39. From the guide post 39, the ribbon extends about a further post 85, then through the nip defined by the drive roller 40 and the idler roller 42, and then back into the storage chamber 26. Also, the rotation of the drive roller 40 acts to tension the ribbon 32 rearwardly along its path of travel between the drive roller 40 and the tension spring 30, and so that the ribbon is tightly pressed against the back side of the ink transfer roller 34.

Figure 1:
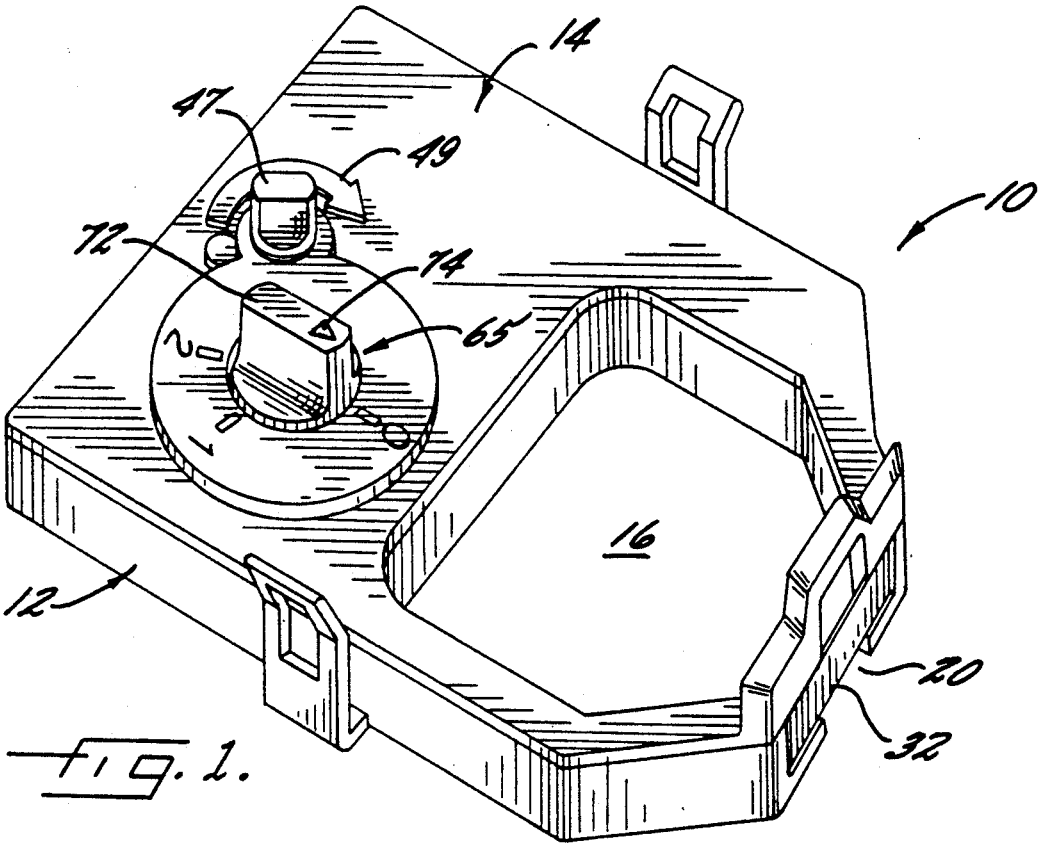
FIG. 1 is a perspective view of a replaceable ribbon cartridge for printers which embodies the features of the present invention.
Figure 6:
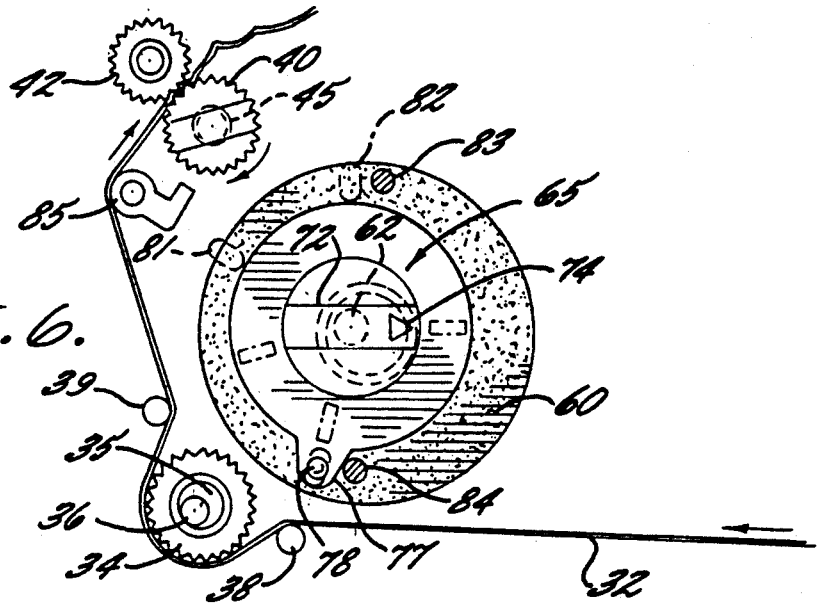
FIGS. 6–8 are fragmentary plan views of the re-inking roller of the present invention in each of three positions as selected by the user, respectively.
Figure 7:
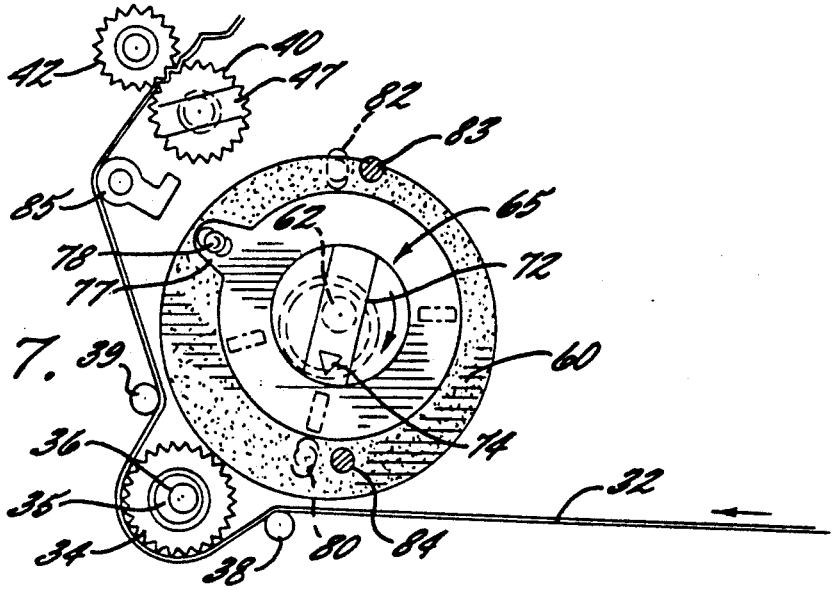
Figure 8:
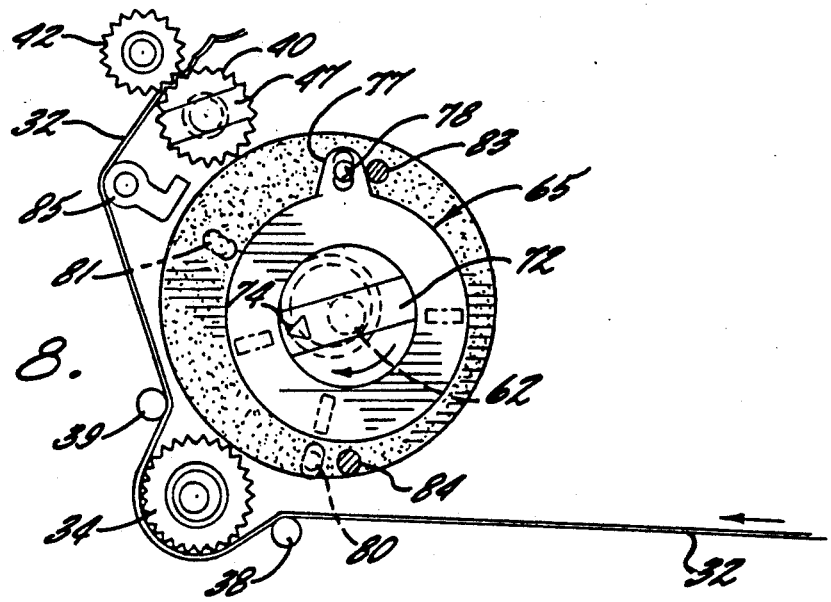

In the illustrated embodiment, the re-inking roller 60 is adapted to be moved by the user between the three positions illustrated in FIGS. 6–8. Initially, the actuator 65 is rotated to the position illustrated in FIG. 6, and so that the re-inking roller assumes a neutral or inoperative position O, where it is separated from both the ink transfer roller 34 and the drive roller 40. This neutral position O occurs when the pointer 74 on the finger tab 72 of the actuator 65 is pointed toward the "0" symbol on the cover 14 as seen in FIG. 1.

The neutral position is useful in that it avoids having the peripheral surface of the re-inking roller 60 compressed by contact with one of the other rollers 34, 40 during long term storage, and which could result in a permanent set. The neutral position may also be used during the initial operation of the cartridge at slow printing speeds, and while adequate ink remains in the ribbon 32. In this position, it will also be noted that the finger 77 of the actuator 65 is in engagement with the post 84, so as to preclude counterclockwise rotation of the actuator as seen in FIGS. 2 and 6. Also, the detent 78 of the actuator 65 is received in the indentation 80 of the cover (note FIG. 5), so as to preclude inadvertent rotation of the actuator from this position.

Alternatively, the user may initially rotate the actuator to a first operative position 1, where the pointer 74 points to the "1" symbol on the cover 14, and where the re-inking roller 60 is moved laterally so as to be in substantial contact only with the ink transfer roller 34 as seen in FIG. 7. Also, the detent 78 of the actuator 65 is received in the indentation 81 of the cover, so as to preclude inadvertent rotation of the actuator. In this position, the tension imparted to the ribbon by the drive means will cause the ribbon 32 to tightly engage the rear surface of the ink transfer roller 34 and to thereby bias the ink transfer roller into firm contact with the re-inking roller. Thus an adequate delivery of the ink from the re-inking roller to the ribbon is assured.

In heavy duty applications, such as the printing of graphics, or when the print quality deteriorates, the user may rotate the actuator 65 to a second operative position 2, where the pointer 74 points to the "2" symbol on the cover, and where the detent 78 enters the indentation 82, and as seen in FIG. 8. This causes the re-inking roller 60 to firmly engage both the ink transfer roller 34 and the drive roller 40, and thus in this position, two ink transfer points are provided, namely, the ink transfer roller 34 and the drive roller 40. Further, the fact that the ribbon is squeezed in the nip formed between the drive roller 40 and the idler roller 42 results in a heavy application of the ink from the surface of the drive roller into the fabric of the ribbon. Thus the ink transfer rate to the ribbon by the drive roller 40 is typically significantly greater than that imparted by the ink transfer roller 34. In the position 2, the finger 77 is in engagement with the post 83, so as to preclude further clockwise rotation of the actuator as seen in FIGS. 2 and 8.

While not shown in the illustrated embodiment, it is further contemplated that the cartridge 10 could be designed to permit rotation of the actuator 65 and movement of the re-inking roller 60 to a third operative position wherein the re-inking roller is in substantial contact only with the drive roller 40. This would provide an intermediate transfer rate, which could be desirable in some applications.

In the drawings and specification, there has been set forth a preferred embodiment of the invention, and although specific terms are employed, they are used in a generic and descriptive sense only and not for purposes of limitation.

That which is claimed is:

1. A replaceable ribbon cartridge for printers and which has a user controllable re-inking capability, comprising a casing, an endless ribbon positioned within said casing so as to be disposed along a path which includes a portion outside of said casing at a printing location, drive means for advancing said ribbon along said path and comprising a drive roller rotatably mounted in said casing adjacent said path and so as to be in contact with said ribbon, an ink transfer roller rotatably mounted in said casing adjacent said path and so as to be in contact with said ribbon, a porous re-inking roller, and means rotatably mounting said re-inking roller in said casing and including means controllable by the user for laterally moving said re-inking roller between a first operative position in substantial contact only with said ink transfer roller and a second operative position in substantial contact with both said ink transfer roller and said drive roller.

2. The ribbon cartridge as defined in claim 1 further comprising means rotatably mounting said ink transfer roller so as to be movable a predetermined distance toward and away from said re-inking roller, and with said path of said ribbon being positioned so that the ribbon contacts the ink transfer roller on the side thereof opposite said re-inking roller and the tension of the ribbon tends to move the ink transfer roller toward said re-inking roller.

3. The ribbon cartridge as defined in claim 1 wherein said drive means further comprises an idler roller rotatably mounted to said casing at a location on the side of said drive roller opposite said re-inking roller and for movement toward and away from said drive roller, and means for biasing said idler roller toward said drive roller, and with said path of said ribbon passing between said drive roller and said idler roller.

4. The ribbon cartridge as defined in claim 3 wherein said ink transfer roller and said drive roller each include axially directed spline means on the outer periphery thereof for facilitating the transfer of ink from said re-inking roller to said ribbon.

5. The ribbon cartridge as defined in claim 1 wherein said means rotatably mounting said re-inking roller comprises a mounting post fixedly mounted to said casing, a central opening extending through said re-inking roller coaxially with respect to the peripheral surface thereof, with said mounting post being received in said central opening, and with said central opening having a diameter substantially greater than that of said post so as to permit relative lateral movement therebetween.

6. The ribbon cartridge as defined in claim 5 wherein said means for moving said re-inking roller comprises an actuator which includes a cylindrical shaft sized so as to be closely received in said central opening of said re-inking roller, with said cylindrical shaft defining a shaft axis and an outer end, and a bore extending axially into said outer end of said shaft and being laterally offset from said shaft axis, and with said bore receiving said mounting post therein such that rotation of said actuator causes said re-inking roller to laterally move about said mounting post.

7. The ribbon cartridge as defined in claim 6 wherein said actuator further comprises an integral tab adapted to be engaged by the fingers of the user for rotating the same about the mounting post, and so as to move said re-inking roller between said first and second positions.

8. The ribbon cartridge as defined in claim 7 wherein said actuator further comprises a radial flange, with said flange including an axial button thereon, and wherein said casing includes a cover closely overlying said flange and with said cover including a plurality of indentations positioned for respectively receiving said button therein at each of said first and second positions.

9. The ribbon cartridge as defined in claim 8 wherein said cover has an opening therethrough, and wherein said tab extends through said opening so as to be readily gripped by the fingers of the user.

10. The ribbon cartridge as defined in claim 8 wherein said flange of said actuator includes a radial finger at the periphery thereof, and said cover mounts a pair of posts which are adapted to be engaged by said radial finger so as to limit the rotational movement of said actuator between predetermined limits defined by the location of said posts.

11. The ribbon cartridge as defined in claim 1 wherein said means for moving said re-inking roller has provision for moving the same to a neutral position wherein said re-inking roller has no substantial contact with either said ink transfer roller or said drive roller.

12. A replaceable ribbon cartridge for printers and which has a user controllable re-inking capability, comprising a casing, an endless ribbon positioned within said casing so as to be disposed along a path which includes a portion outside of said casing at a printing location, drive means for advancing said ribbon along said path and comprising a drive roller rotatably mounted in said casing adjacent said path and so as to be in contact with said ribbon, an ink transfer roller rotatably mounted in said casing adjacent said path and so as to be in contact with said ribbon, a porous re-inking roller, and means rotatably mounting said re-inking roller in said casing and including means controllable by the user for moving said re-inking roller between a first operative position in substantial contact with only one of said ink transfer roller and said drive roller, and a second operative position in substantial contact with at least the other of said ink transfer roller and said drive roller.

13. A replaceable ribbon cartridge for printers and which has a user controllable re-inking capability, comprising a casing, an endless ribbon positioned within said casing so as to be disposed along a path which includes a portion outside of said casing at a printing location, drive means for advancing said ribbon along said path and comprising a drive roller rotatably mounted in said casing adjacent said path and so as to be in contact with said ribbon, an ink transfer roller rotatably mounted in said casing adjacent said path and so as to be in contact with said ribbon, a porous re-inking roller, and means rotatably mounting said re-inking roller in said casing and including means controllable by the user for moving said re-inking roller between a neutral position wherein said re-inking roller has no substantial contact with either said ink transfer roller or said drive roller, and an operative position in substantial contact with both said ink transfer roller and said drive roller.

* * * * *